US006739527B1

(12) United States Patent
Chung

(10) Patent No.: US 6,739,527 B1
(45) Date of Patent: May 25, 2004

(54) SHOWER HEAD ASSEMBLY

(75) Inventor: Chin-Tang Chung, Chang Hua Hsien (TW)

(73) Assignee: Shong I Copper Co., Ltd., Chang Hua Hsien (TW)

( * ) Notice: Subject to any disclaimer, the term of this patent is extended or adjusted under 35 U.S.C. 154(b) by 0 days.

(21) Appl. No.: 10/374,473

(22) Filed: Feb. 24, 2003

(51) Int. Cl.[7] ..... B05B 1/14; B05B 15/08

(52) U.S. Cl. ..... 239/558; 239/107; 239/533.13; 239/587.4; 239/600

(58) Field of Search ..... 239/107, 500, 239/504, 533.13, 533.14, 557, 558, 587.1, 587.4, 600

(56) References Cited

U.S. PATENT DOCUMENTS 2,402,741 A * 6/1946 Draviner ..... 239/533.14
5,172,862 A * 12/1992 Heimann et al. ..... 239/602
5,228,625 A * 7/1993 Grassberger ..... 239/558
5,398,872 A * 3/1995 Joubran ..... 239/446
5,860,599 A * 1/1999 Lin ..... 239/443
6,382,531 B1 * 5/2002 Tracy ..... 239/533.13

* cited by examiner

*Primary Examiner*—John J. Vrablik
(74) *Attorney, Agent, or Firm*—Alan D. Kamrath; Nikolai & Mersereau, P.A.

(57) ABSTRACT

A shower head assembly includes a shade, a water outlet seat, a water outlet disk, a locking disk, a water outlet panel, a mounting tube, a connecting head, and a locking nut. Thus, the water outlet seat and the water outlet disk form a smaller water chamber, thereby reducing the bearing weight of the water outlet disk, the locking disk and the water outlet panel. In addition, the water outlet seat, the water outlet disk, the locking disk and the water outlet panel are combined rigidly and stably without detachment.

18 Claims, 8 Drawing Sheets

SHOWER HEAD ASSEMBLY

BACKGROUND OF THE INVENTION

1. Field of the Invention

The present invention relates to a shower head assembly, and more particularly to a shower head assembly, wherein the water outlet seat and the water outlet disk form a smaller water chamber, thereby reducing the bearing weight of the water outlet disk, the locking disk and the water outlet panel.

2. Description of the Related Art

A conventional shower head assembly in accordance with the prior art shown in FIGS. 1–3 comprises a shade 11, a water outlet panel 12, a mounting tube 13, a connecting head 14, and a locking nut 15. The shade 11 has a top formed with a mounting hole 111 and a bottom formed with a locking portion 112. The water outlet panel 12 is formed with a plurality of water outlet holes 121 and a plurality of spraying heads 16. A seal ring 122 is mounted on the periphery of the water outlet panel 12. The mounting tube 13 is formed with a protruding ring 131 and an outer thread 132. A seal washer 133 is mounted in the mounting tube 13. The mounting tube 13 has a bottom formed with a closed face 134 and a plurality of water inlet holes 135. The connecting head 14 has a first end pivotally mounted on the mounting tube 13 and a second end formed with an inner thread 141. The a locking nut 15 is formed with an inner thread 151 screwed on the outer thread 132 of the mounting tube 13 and has a top formed with an urging flange 152 urged on the connecting head 14.

However, the conventional shower head assembly has the following disadvantages.

1. The shade 11 and the water outlet panel 12 form a larger water chamber, so that the water outlet panel 12 bears a larger water pressure and load, and is easily detached from the shade 11.
2. The shade 11 and the water outlet panel 12 form a larger water chamber, so that the conventional shower head assembly will drop water when the water supply is stopped.
3. The shade 11 and the water outlet panel 12 are combined in a rolling press manner, so that the water outlet panel 12 cannot be detached for washing the inside of the water outlet panel 12.
4. The parts of the conventional shower head assembly are assembled by the soldering and rolling procedures, thereby increasing costs of fabrication.
5. The parts of the conventional shower head assembly are assembled by the soldering and rolling procedures, so that the shade 11 and the water outlet panel 12 are easily scratched due to hit, thereby decreasing the aesthetic quality thereof.
6. The water outlet panel 12 and the spraying heads 16 need to be processed by a screwing process, thereby increasing costs of fabrication.

SUMMARY OF THE INVENTION

The present invention is to mitigate and/or obviate the disadvantage of the conventional shower head assembly.

The primary objective of the present invention is to provide a shower head assembly, wherein the water outlet seat and the water outlet disk form a smaller water chamber, thereby reducing the bearing weight of the water outlet disk, the locking disk and the water outlet panel.

Another objective of the present invention is to provide a shower head assembly, wherein the water outlet seat, the water outlet disk, the locking disk and the water outlet panel are combined rigidly and stably without detachment.

A further objective of the present invention is to provide a shower head assembly, wherein the water stop rib of the water stop flange of the water outlet disk is rested on the inner face of the water outlet seat, and the urging section of the water stop flange of the water outlet disk is urged between the urging ring of the water outlet seat and the resting face of the protruding ring of the locking disk, thereby forming a double water stopping effect without incurring leakage.

A further objective of the present invention is to provide a shower head assembly, wherein the water outlet seat and the water outlet disk form a smaller water chamber, so that the shower head assembly will not drop water when the water supply is stopped.

A further objective of the present invention is to provide a shower head assembly, wherein the water outlet seat and the locking disk are combined by the screw members, so that the water outlet seat and the locking disk can be detached, thereby facilitating the user washing the water outlet seat.

A further objective of the present invention is to provide a shower head assembly, wherein the water outlet panel and the nozzle heads need not to be threaded, thereby decreasing costs of fabrication.

A further objective of the present invention is to provide a shower head assembly, wherein the parts of the shower head assembly can be assembled easily, rapidly and conveniently, thereby decreasing costs of fabrication.

A further objective of the present invention is to provide a shower head assembly, wherein the parts of the shower head assembly can be assembled without having to be treated by the soldering and rolling procedures, thereby enhancing the aesthetic quality thereof.

In accordance with the present invention, there is provided a shower head assembly, comprising a shade, a water outlet seat, a water outlet disk, a locking disk, a water outlet panel, a mounting tube, a connecting head, and a locking nut, wherein:

the water outlet seat is mounted in the shade and has a periphery formed with a locking flange, the water outlet seat has a center formed with a mounting body extended upward therefrom, the mounting body has an inner wall formed with a stepped hole;

the water outlet disk is mounted in the shade and rested on the water outlet seat, the water outlet disk has a periphery formed with a substantially inverted U-shaped water stop flange extended outward therefrom;

the locking disk is mounted in the shade and rested on the water outlet disk, the locking disk has a top formed with a protruding ring;

the water outlet panel is mounted in the shade and rested on the locking disk;

the mounting tube is mounted between the shade and the water outlet seat;

the connecting head is mounted on the shade; and the locking nut is mounted on the shade and secured on a top of the mounting tube.

Further benefits and advantages of the present invention will become apparent after a careful reading of the detailed description with appropriate reference to the accompanying drawings.

DETAILED DESCRIPTION OF THE INVENTION

Figure 1:
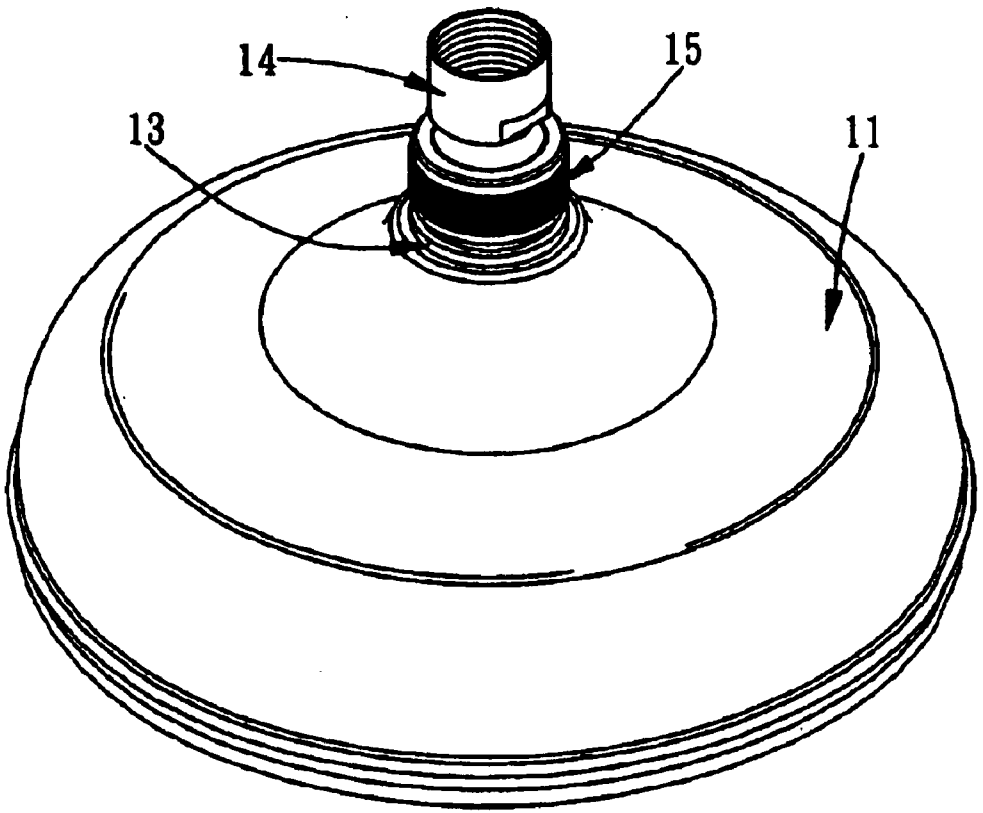
FIG. 1 PRIOR ART
FIG. 1 is a perspective view of a conventional shower head assembly in accordance with the prior art.
Figure 2:
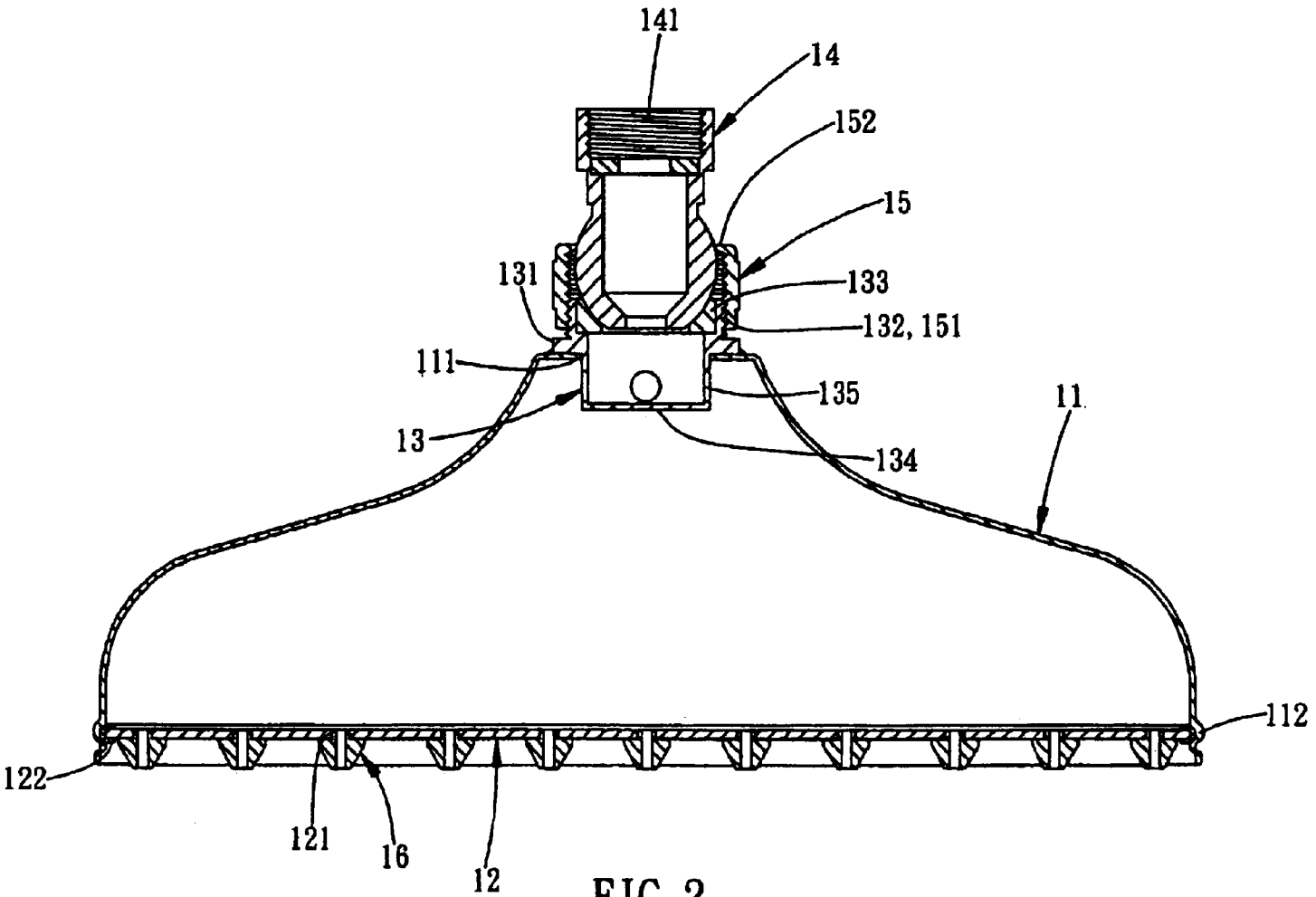
FIG. 2 PRIOR ART
FIG. 2 is a plan cross-sectional view of the conventional shower head assembly as shown in FIG. 1.
Figure 3:
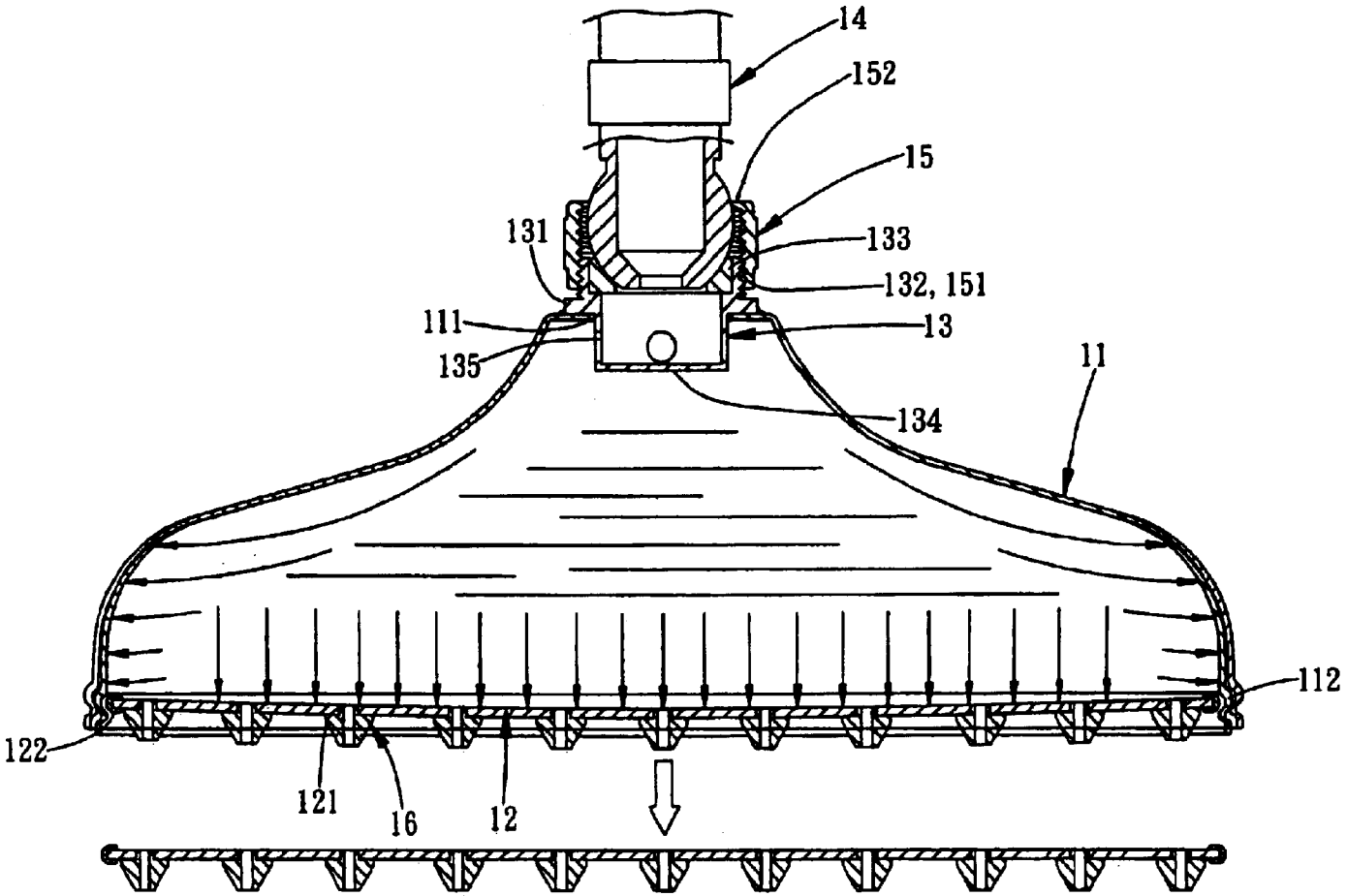
FIG. 3 PRIOR ART
FIG. 3 is a schematic operational view of the conventional shower head assembly as shown in FIG. 2.

Referring to the drawings and initially to FIGS. 4–7, a shower head assembly in accordance with the preferred embodiment of the present invention comprises a shade 20, a water outlet seat 30, a water outlet disk 40, a locking disk 50, a water outlet panel 60, a mounting tube 70, a connecting head 80, and a locking nut 90.

The shade 20 has a top formed with a mounting hole 21.

Figures 4, 4A, 4B:
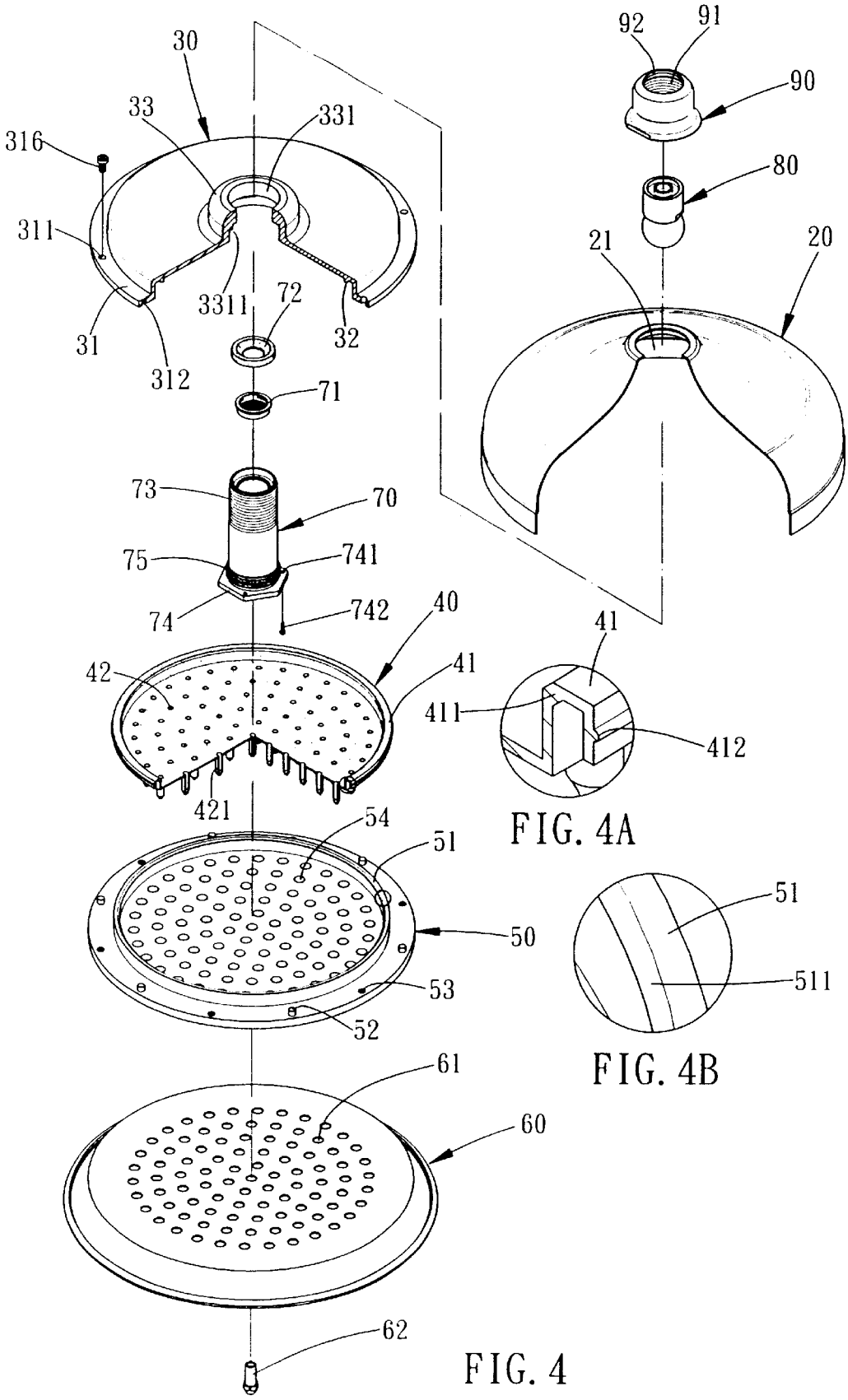
FIG. 4 is an exploded perspective view of a shower head assembly in accordance with the preferred embodiment of the present invention.
FIG. 4A is a partially enlarged cross-sectional view of the shower head assembly as shown in FIG. 4.
FIG. 4B is a partially enlarged cross-sectional view of the shower head assembly as shown in FIG. 4.
Figure 5:
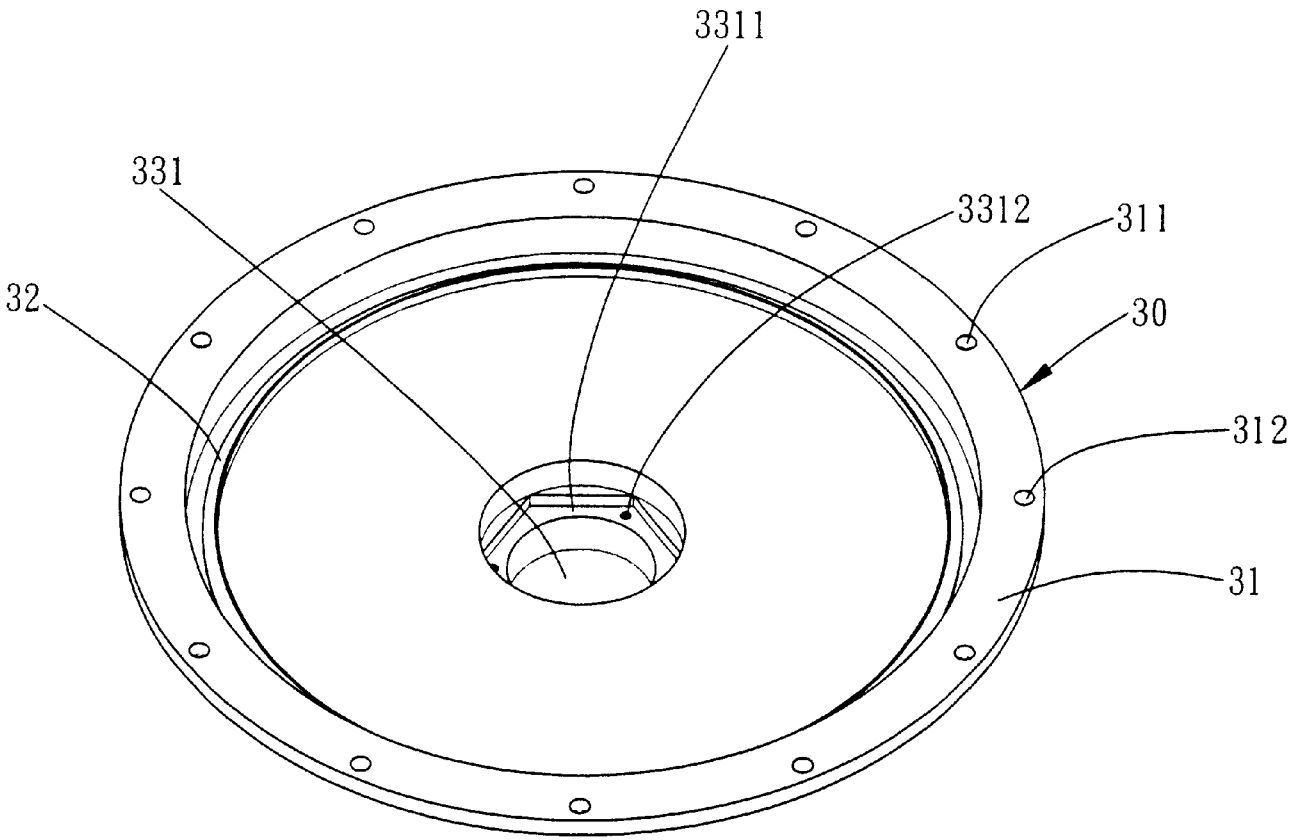
FIG. 5 is a bottom perspective view of a water outlet seat of the shower head assembly in accordance with the preferred embodiment of the present invention.
Figure 6:
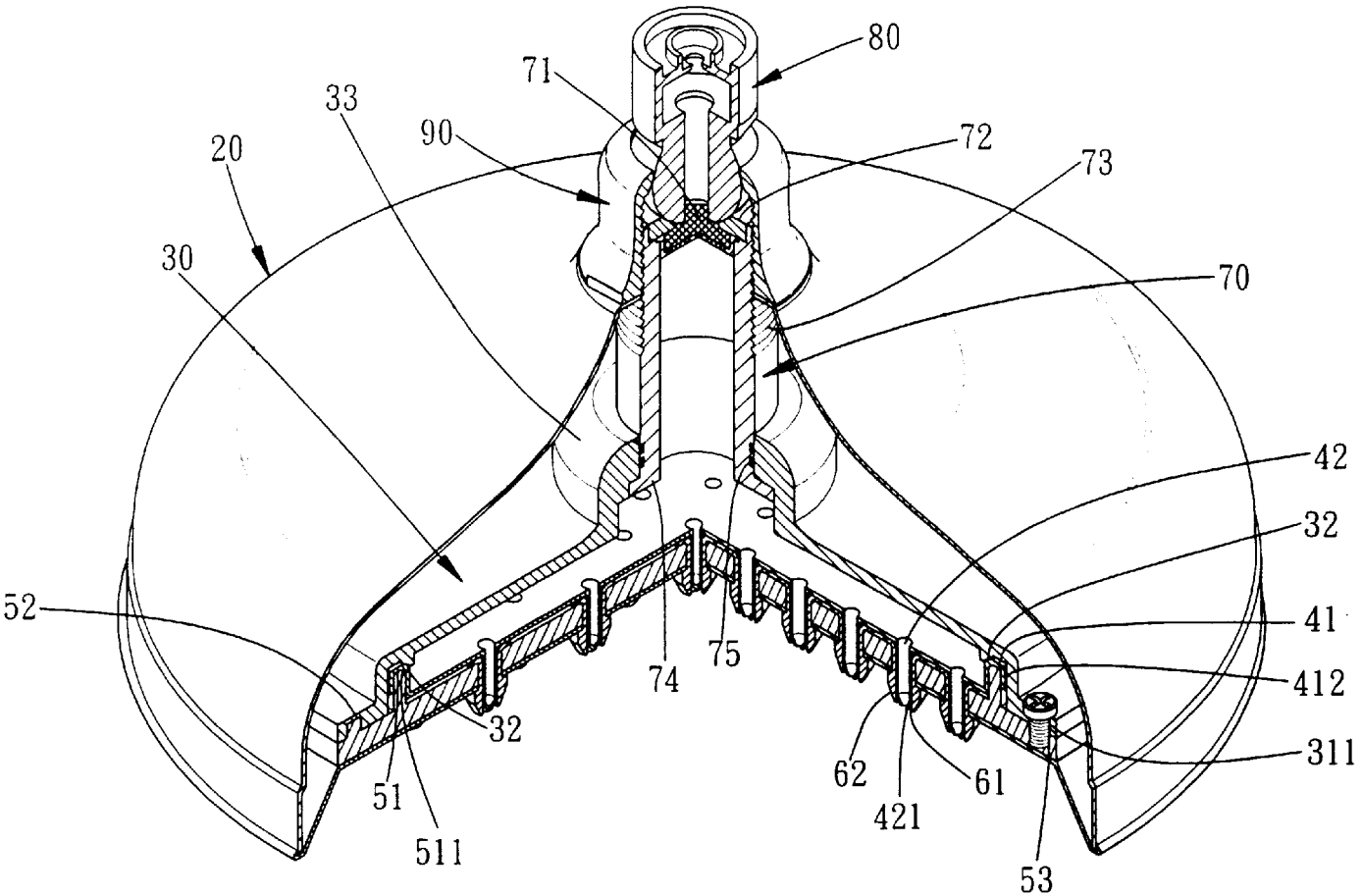
FIG. 6 is a partially cut-away perspective cross-sectional assembly view of the shower head assembly in accordance with the preferred embodiment of the present invention.

As shown in FIGS. 4 and 5, the water outlet seat 30 is mounted in the shade 20 and has a circular disk shape. The water outlet seat 30 has a periphery formed with a locking flange 31. The locking flange 31 is formed with a plurality of equally spaced locking holes 311, and has a bottom face formed with a plurality of equally spaced positioning recesses 312. Preferably, the positioning recesses 312 and the locking holes 311 of the water outlet seat 30 are arranged in a staggered manner. The water outlet seat 30 has a bottom face having a periphery formed with a tapered urging ring 32. The water outlet seat 30 has a center formed with a mounting body 33 extended upward therefrom. The mounting body 33 has an inner wall formed with a stepped hole 331. The stepped hole 331 of the mounting body 33 has a upper portion and a lower portion having a diameter greater than that of the upper portion. The lower portion of the stepped hole 331 of the mounting body 33 has a wall formed with a hexagonal fixing recess 3311 and a plurality of equally spaced screw bores 3312.

As shown in FIGS. 4 and 4A, the water outlet disk 40 is mounted in the shade 20 and rested on the water outlet seat 30. The water outlet disk 40 is made of the rubber material. The water outlet disk 40 has a periphery formed with a substantially inverted U-shaped water stop flange 41 extended outward therefrom. The water stop flange 41 has an inner side formed with an oblique urging section 411 rested on the urging ring 32 (see FIG. 7A) of the water outlet seat 30 and an outer side formed with an arcuate water stop rib 412 rested on an inner face of the water outlet seat 30. The water outlet disk 40 has a surface formed with a plurality of water outlet holes 42. Each of the water outlet holes 42 has a bottom extended downward and formed with a hollow water ejection post 421.

As shown in FIGS. 4 and 4B, the locking disk 50 is mounted in the shade 20 and rested on the water outlet disk 40. The locking disk 50 has a top formed with a protruding ring 51. The protruding ring 51 has a top having an inner side formed with an oblique resting face 511 rested on the urging section 411 (see FIG. 7A) of the water stop flange 41 of the water outlet disk 40. The locking disk 50 has a periphery formed with a plurality of equally spaced positioning posts 52 each inserted into a respective one of the positioning recesses 312 of the water outlet seat 30, and formed with a plurality of equally spaced screw bores 53. The screw bores 53 and the positioning posts 52 of the locking disk 50 are arranged in a staggered manner. The shower head assembly further comprises a plurality of locking screws 316 each extended through a respective one of the locking holes 311 of the water outlet seat 30 and each screwed into a respective one of the screw bores 53 of the locking disk 50, so that the water outlet seat 30 is combined with the locking disk 50. The locking disk 50 is formed with a plurality of through holes 54 located in the protruding ring 51.

The water outlet panel 60 is mounted in the shade 20 and rested on the locking disk 50. The water outlet panel 60 has a tapered shape. The water outlet panel 60 is formed with a plurality of through holes 61. The water outlet panel 60 includes a plurality of hollow nozzle heads 62 each extended through a respective one of the through holes 61 of the water outlet panel 60 and a respective one of the through holes 54 of the locking disk 50. Each of the water ejection posts 421 of the water outlet disk 40 is inserted into a respective one of the hollow nozzle heads 62 of the water outlet panel 60.

The mounting tube 70 is mounted between the shade 20 and the water outlet seat 30. The mounting tube 70 has a top having an inner wall receiving a filter net 71 and a seal washer 72 and an outer wall formed with an outer thread 73. The mounting tube 70 has a bottom formed with a hexagonal fixing plate 74 secured in the hexagonal fixing recess 3311 of the water outlet seat 30. The mounting tube 70 includes two seal rings 75 rested on the fixing plate 74 and urged on the upper portion of the stepped hole 331 of the water outlet seat 30. The fixing plate 74 of the mounting tube 70 has a periphery formed with a plurality of equally spaced fixing holes 741. The shower head assembly further comprises a plurality of locking screws 742 each extended through a respective one of the fixing holes 741 of the fixing plate 74 of the mounting tube 70 and each screwed into a respective one of the screw bores 3312 of the mounting body 33 of the water outlet seat 30, so that the fixing plate 74 of the mounting tube 70 is combined with the mounting body 33 of the water outlet seat 30.

The connecting head 80 is a hollow body. The connecting head 80 is mounted on the shade 20, and has a spherical-shaped first end rested on the seal washer 72 of the mounting tube 70, and a second end having a cylindrical shape.

The locking nut 90 is mounted on the shade 20, and secured on the top of the mounting tube 70. Preferably, the locking nut 90 has an inner wall formed with an inner thread 91 screwed on the outer thread 73 of the mounting tube 70. The locking nut 90 has a top formed with an urging flange 92.

In assembly, the water outlet panel 60 is rested on the locking disk 50. Then, each of the hollow nozzle heads 62 of the water outlet panel 60 is extended through a respective one of the through holes 61 of the water outlet panel 60 and a respective one of the through holes 54 of the locking disk 50, and is riveted on the locking disk 50, so that the water outlet panel 60 is combined with the locking disk 50. Then, each of the water ejection posts 421 of the water outlet disk 40 is inserted into a respective one of the nozzle heads 62 of the water outlet panel 60, so that the water outlet disk 40 is combined with the locking disk 50 and the water outlet panel 60. Then, the mounting tube 70 is inserted into and protruded outward from the mounting body 33 of the water outlet seat 30, with the two seal rings 75 of the mounting tube 70 being urged on the upper portion of the stepped hole 331 of the water outlet seat 30, and with the fixing plate 74 of the mounting tube 70 being fixed on the fixing recess 3311 of the mounting body 33 of the water outlet seat 30 by the locking screws 742. Then, the locking disk 50 is mounted on the water outlet seat 30, with each of the positioning posts 52 of the locking disk 50 being inserted into a respective one of the positioning recesses 312 of the water outlet seat 30. Then, each of the locking screws 316 is extended through a respective one of the locking holes 311 of the water outlet seat 30 and screwed into a respective one of the screw bores 53 of the locking disk 50, so that the water outlet seat 30 is combined with the locking disk 50.

Figure 7:
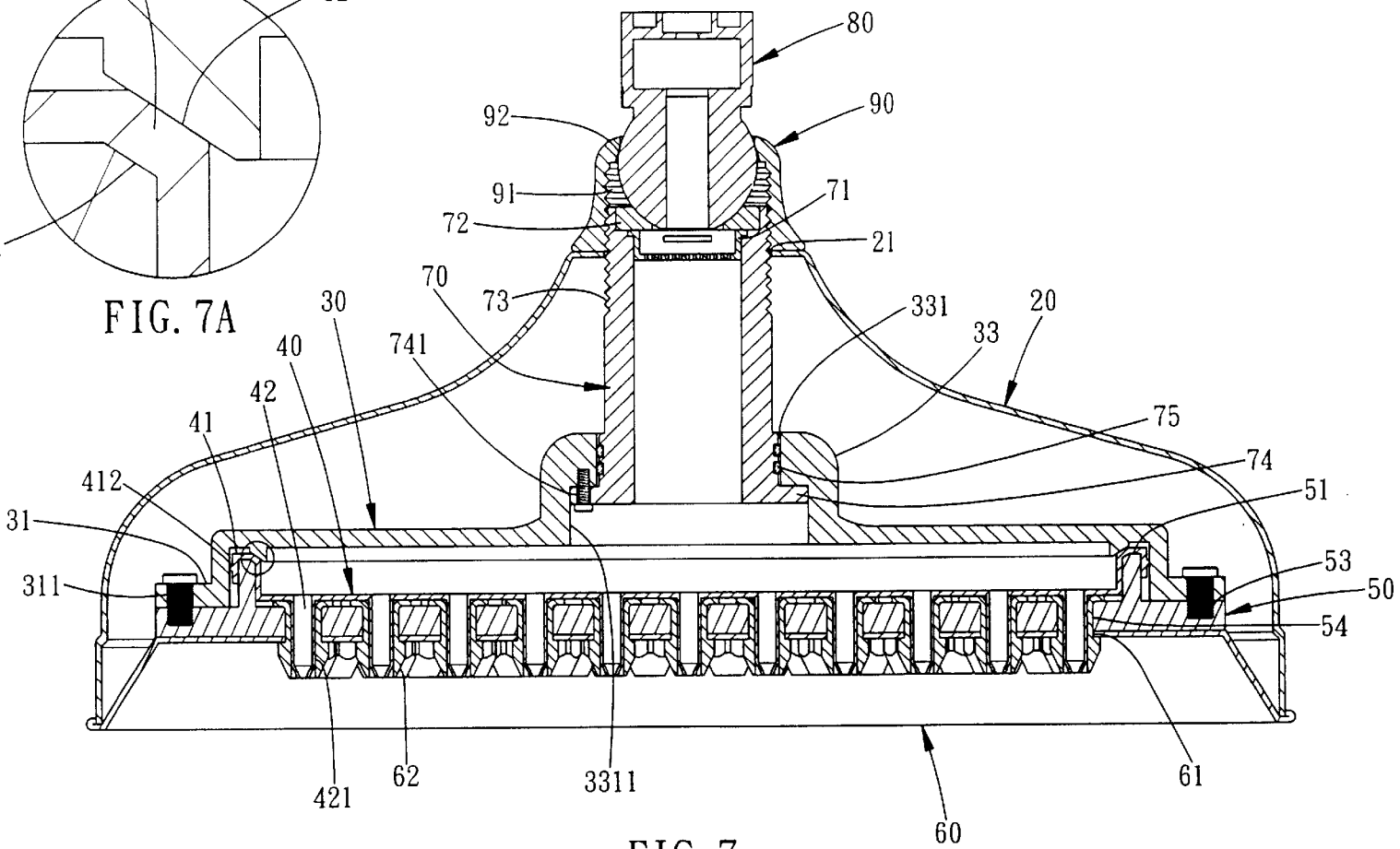
FIG. 7 is a plan cross-sectional assembly view of the shower head assembly in accordance with the preferred embodiment of the present invention.
Figure 7A:
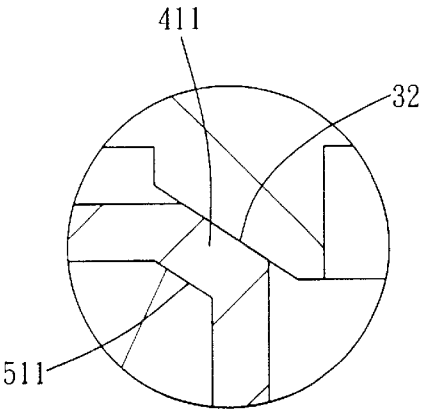
FIG. 7A is a partially enlarged view of the shower head assembly as shown in FIG. 7.

At this time, the water stop rib 412 of the water stop flange 41 of the water outlet disk 40 is rested on the inner face of the water outlet seat 30 as shown in FIG. 7, and the urging section 411 of the water stop flange 41 of the water outlet disk 40 is urged between the urging ring 32 of the water outlet seat 30 and the resting face 511 of the protruding ring 51 of the locking disk 50 as shown in FIG. 7A, thereby forming a double water stopping effect.

Then, the mounting tube 70 is extended through the mounting hole 21 of the shade 20. Then, the connecting head 80 is mounted on the seal washer 72 of the mounting tube 70. Then, the locking nut 90 is mounted on the connecting head 80, with its inner thread 91 being screwed on the outer thread 73 of the mounting tube 70, thereby fixing the shade 20 on the water outlet seat 30. At this time, the urging flange 92 of the locking nut 90 is urged on the connecting head 80.

Figures 8, 8A:
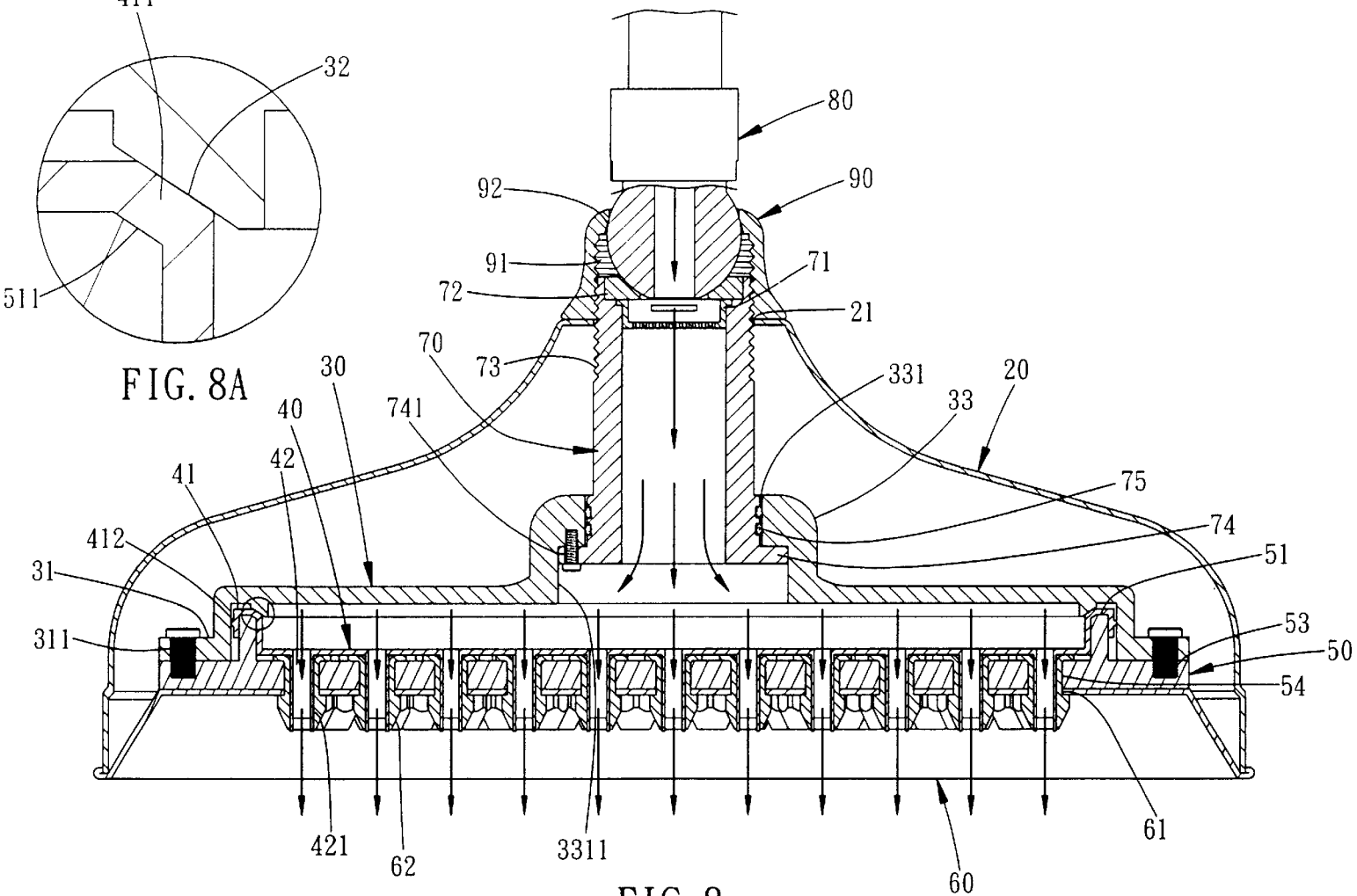
FIG. 8 is a schematic operational view of the shower head assembly as shown in FIG. 7 in use.
FIG. 8A is a partially enlarged view of the shower head assembly as shown in FIG. 8.

In operation, referring to FIGS. 8 and 8A, the connecting head 80 is connected to the water pipe (not shown). Thus, the water flows through the connecting head 80, the filter net 71, the mounting tube 70, the water outlet seat 30, the water outlet disk 40, each of the water ejection posts 421 of the water outlet disk 40 and each of the nozzle heads 62 of the water outlet panel 60. Then, the water flow is ejected outward through each of the nozzle heads 62 of the water outlet panel 60.

Accordingly, the shower head assembly in accordance with the present invention has the following advantages.

1. The water outlet seat 30, the water outlet disk 40, the locking disk 50 and the water outlet panel 60 are combined rigidly and stably without detachment.
2. The water outlet seat 30 and the water outlet disk 40 form a smaller water chamber, thereby reducing the bearing weight of the water outlet disk 40, the locking disk 50 and the water outlet panel 60.
3. The water stop rib 412 of the water stop flange 41 of the water outlet disk 40 is rested on the inner face of the water outlet seat 30 as shown in FIG. 7, and the urging section 411 of the water stop flange 41 of the water outlet disk 40 is urged between the urging ring 32 of the water outlet seat 30 and the resting face 511 of the protruding ring 51 of the locking disk 50 as shown in FIG. 7A, thereby forming a double water stopping effect without incurring leakage.
4. The water outlet seat 30 and the water outlet disk 40 form a smaller water chamber, so that the shower head assembly will not drop water when the water supply is stopped.
5. The water outlet seat 30 and the locking disk 50 are combined by the screw members, so that the water outlet seat 30 and the locking disk 50 can be detached, thereby facilitating the user washing the water outlet seat 30.
6. The water outlet panel 60 and the nozzle heads 62 need not to be threaded, thereby decreasing costs of fabrication.
7. The parts of the shower head assembly can be assembled easily, rapidly and conveniently, thereby decreasing costs of fabrication.
8. The parts of the shower head assembly can be assembled without having to be treated by the soldering and rolling procedures, thereby enhancing the aesthetic quality thereof.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head assembly, comprising a shade, a water outlet seat, a water outlet disk, a locking disk, a water outlet panel, a mounting tube, a connecting head, and a locking nut, wherein:

the water outlet seat is mounted in the shade and has a periphery formed with a locking flange, the water outlet seat has a center formed with a mounting body extended upward therefrom, the mounting body has an inner wall formed with a stepped hole;

the water outlet disk is mounted in the shade and rested on the water outlet seat, the water outlet disk has a periphery formed with a substantially inverted U-shaped water stop flange extended outward therefrom;

the locking disk is mounted in the shade and rested on the water outlet disk, the locking disk has a top formed with a protruding ring;

the water outlet panel is mounted in the shade and rested on the locking disk;

the mounting tube is mounted between the shade and the water outlet seat;

the connecting head is mounted on the shade; and the locking nut is mounted on the shade and secured on a top of the mounting tube.

2. The shower head assembly in accordance with claim 1, wherein the shade has a top formed with a mounting hole.

3. The shower head assembly in accordance with claim 1, wherein the water outlet seat has a bottom face having a periphery formed with an urging ring, the water stop flange has an inner side formed with an oblique urging section rested on the urging ring of the water outlet seat and an outer side formed with an arcuate water stop rib rested on an inner face of the water outlet seat, and the protruding ring has a top having an inner side formed with an oblique resting face rested on the urging section of the water stop flange of the water outlet disk.

4. The shower head assembly in accordance with claim 1, wherein the mounting tube has a top having an outer wall formed with an outer thread, and the locking nut has an inner wall formed with an inner thread screwed on the outer thread of the mounting tube.

5. The shower head assembly in accordance with claim 1, wherein the locking nut has a top formed with an urging flange urged on the connecting head.

6. The shower head assembly in accordance with claim 1, wherein the urging ring of the water outlet seat has a tapered shape.

7. The shower head assembly in accordance with claim 1, wherein the locking flange is formed with a plurality of equally spaced locking holes and has a bottom face formed with a plurality of equally spaced positioning recesses, and the locking disk has a periphery formed with a plurality of equally spaced positioning posts each inserted into a respective one of the positioning recesses of the water outlet seat, and formed with a plurality of equally spaced screw bores.

8. The shower head assembly in accordance with claim 7, wherein the positioning recesses and the locking holes of the water outlet seat are arranged in a staggered manner.

9. The shower head assembly in accordance with claim 7, wherein the screw bores and the positioning posts of the locking disk are arranged in a staggered manner.

10. The shower head assembly in accordance with claim 7, further comprising a plurality of locking screws each extended through a respective one of the locking holes of the water outlet seat and each screwed into a respective one of the screw bores of the locking disk, so that the water outlet seat is combined with the locking disk.

11. The shower head assembly in accordance with claim 1, wherein the stepped hole of the mounting body has a upper portion and a lower portion having a diameter greater than that of the upper portion.

12. The shower head assembly in accordance with claim 11, wherein the mounting tube includes two seal rings urged on the upper portion of the stepped hole of the water outlet seat.

13. The shower head assembly in accordance with claim 11, wherein the lower portion of the stepped hole of the mounting body has a wall formed with a hexagonal fixing recess and a plurality of equally spaced screw bores, and the mounting tube has a bottom formed with a hexagonal fixing plate secured in the hexagonal fixing recess of the water outlet seat.

14. The shower head assembly in accordance with claim 13, wherein the fixing plate of the mounting tube has a periphery formed with a plurality of equally spaced fixing holes, and the shower head assembly further comprises a plurality of locking screws each extended through a respective one of the fixing holes of the fixing plate of the mounting tube and each screwed into a respective one of the screw bores of the mounting body of the water outlet seat, so that the fixing plate of the mounting tube is combined with the mounting body of the water outlet seat.

15. The shower head assembly in accordance with claim 1, wherein the water outlet disk has a surface formed with a plurality of water outlet holes, the locking disk is formed with a plurality of through holes located in the protruding ring, the water outlet panel is formed with a plurality of through holes, and includes a plurality of hollow nozzle heads each extended through a respective one of the through holes of the water outlet panel and a respective one of the through holes the locking disk.

16. The shower head assembly in accordance with claim 15, wherein each of the water outlet holes has a bottom extended downward and formed with a hollow water ejection post inserted into a respective one of the hollow nozzle heads of the water outlet panel.

17. The shower head assembly in accordance with claim 1, wherein the mounting tube has a top having an inner wall receiving a filter net and a seal washer.

18. The shower head assembly in accordance with claim 17, wherein the connecting head has a spherical-shaped first end rested on the seal washer of the mounting tube and a second end having a cylindrical shape.

* * * * *